US009978219B2

(12) United States Patent
Wenker et al.

(10) Patent No.: US 9,978,219 B2
(45) Date of Patent: May 22, 2018

(54) METHOD FOR PROVIDING A CRIBBAGE CASINO GAME

(71) Applicant: IGT, Las Vegas, NV (US)

(72) Inventors: Ross D. Wenker, Reno, NV (US); Bryan D. Wolf, Reno, NV (US); Lance M. Orner, Sparks, NV (US)

(73) Assignee: IGT, Las Vegas, NV (US)

( * ) Notice: Subject to any disclaimer, the term of this patent is extended or adjusted under 35 U.S.C. 154(b) by 413 days.

(21) Appl. No.: 14/088,204

(22) Filed: Nov. 22, 2013

(65) Prior Publication Data

US 2015/0087373 A1 Mar. 26, 2015

Related U.S. Application Data

(60) Provisional application No. 61/880,788, filed on Sep. 20, 2013.

(51) Int. Cl.
*G07F 17/32* (2006.01)
*A63F 1/00* (2006.01)

(52) U.S. Cl.
CPC ..... *G07F 17/3293* (2013.01); *A63F 1/00* (2013.01); *G07F 17/326* (2013.01)

(58) Field of Classification Search
None
See application file for complete search history.

(56) References Cited

U.S. PATENT DOCUMENTS 6,554,282 B2 4/2003 Vanderkley et al.
6,824,137 B2 11/2004 Foster et al.
8,210,539 B2 7/2012 Brunelle
2005/0026669 A1* 2/2005 Nelson ..... G07F 17/32 463/16
2005/0073101 A1* 4/2005 Foster ..... A63F 1/00 273/292
2006/0068883 A1* 3/2006 Randall ..... G07F 17/34 463/20
2012/0202599 A1* 8/2012 Cohen ..... A63F 13/12 463/42

(Continued)

OTHER PUBLICATIONS

Martin, Philip et al. Optimal Expected Values for Cribbage Hands [online]. [retrieved Sep. 19, 2015]. Retrieved from the Internet: <https://www.math.hmc.edu/seniorthesis/archives/2000/pmartin/pmartin-2000-thesis.pdf>.*

(Continued)

*Primary Examiner* — Robert T Clarke, Jr.

(74) *Attorney, Agent, or Firm* — Neal, Gerber & Eisenberg LLP

(57) ABSTRACT

A method for providing a casino cribbage game includes receiving a bet from a player, dealing a plurality of player cards from at least one deck of cards to the player, dealing one or more crib cards from the at least one deck to a crib hand, receiving at least one discard from the player cards to define a player hand from the player cards remaining, moving the at least one discard to the crib hand, exposing a starter card from the at least one deck of cards, totaling a value of the player hand in conjunction with the starter card, totaling a value of the crib hand in conjunction with the starter card, and determining a payout by comparing at least one of the value of the player hand and the value of the crib hand to a pay table.

20 Claims, 8 Drawing Sheets

(56) References Cited

U.S. PATENT DOCUMENTS

2013/0084990 A1* 4/2013 Nicely ..... G07F 17/3239
463/42

OTHER PUBLICATIONS

Cribbage Variations [online] [dated Aug. 31, 2013]. [retrieved Apr. 8, 2016]. Retrieved from the Internet: <https://web.archive.org/web/20130831023406/http://www.pagat.com/invented/crib_vars.html>.*

* cited by examiner

500

| | |
|---|---|
| Wager | 5 |
| Payback % | 97.28% |

| Points | Payouts for each outcome |
|---|---|
| 0 –9 | 0 |
| 10 – 11 | 1 |
| 12 – 13 | 2 |
| 14 – 15 | 3 |
| 16 – 19 | 5 |
| 20 – 21 | 10 |
| 22 – 23 | 20 |
| 24 – 25 | 30 |
| 26 – 27 | 40 |
| 28 – 29 | 50 |
| 30 – 34 | 80 |
| 35 – 39 | 100 |
| 40 – 41 | 5,000 |
| 42 – 43 | 10,000 |
| 44 | 50,000 |
| 45 – 47 | 100,000 |
| 48 – 49 | 500,000 |
| 50 – 53 | 1,000,000 |

FIG. 5

METHOD FOR PROVIDING A CRIBBAGE CASINO GAME

CROSS-REFERENCE TO RELATED APPLICATIONS

The present application claims priority under 35 U.S.C. § 119(e) to U.S. Provisional Patent Application No. 61/880,788, filed on Sep. 20, 2013 and titled "Method for Providing a Cribbage Casino Game," the entirety of which is incorporated by reference.

BACKGROUND

Cribbage is typically played with two or more players and several hands are required to complete a single game. In addition, each hand includes a "play phase" and a "show phase." Before the play phase, each player is dealt a number of cards, the players discard at least one card, and a "starter" or cut card is chosen. During the play phase, players play their cards to score points until all cards have been played. During the subsequent show phase, each player receives points based on the content of the player's hand in conjunction with the starter card. The points accumulated during the play phase and the show phase are added to each player's total, and subsequent hands are dealt and played until one of the players reaches a target number of points.

SUMMARY

An exemplary embodiment relates to a method for providing a casino cribbage game. The method includes receiving a bet from a player, dealing a plurality of player cards from at least one deck of cards to the player, dealing one or more crib cards from the at least one deck to a crib hand, receiving at least one discard from the player cards to define a player hand from the player cards remaining, moving the at least one discard to the crib hand, exposing a starter card from the at least one deck of cards, totaling a value of the player hand in conjunction with the starter card, totaling a value of the crib hand in conjunction with the starter card, and determining a payout by comparing at least one of the value of the player hand and the value of the crib hand to a pay table.

Another exemplary embodiment relates to a gaming device for providing a single player video cribbage game. The gaming device includes a cabinet, a display coupled to the cabinet, a user input mechanism coupled to the cabinet and configured to receive input from the player, and a game controller coupled to the cabinet. The game controller is configured to receive a bet from the player, deal a plurality of player cards from at least one deck of cards to the player, deal one or more crib cards from the at least one deck to a crib hand, receive at least one discard from the player cards to define a player hand from the player cards remaining, move the at least one discard to the crib hand, expose starter card from the at least one deck, total a value of the player hand in conjunction with the starter card, total a value of the crib hand in conjunction with the starter card, and determine a payout by comparing at least one of the value of the player hand and the value of the crib hand to a pay table.

Another exemplary embodiment relates to a computer-readable storage medium having machine instructions stored therein, the instructions being executable by a processor to cause the processor to perform operations. The operations include receiving a bet from a player in a cribbage game, dealing a plurality of player cards from at least one deck of cards to the player, dealing one or more crib cards from the at least one deck to a crib hand, receiving at least one discard from the player cards to define a player hand from the player cards remaining, moving the at least one discard to the crib hand, exposing a starter card from the at least one deck of cards, totaling a value of the player hand in conjunction with the starter card, totaling a value of the crib hand in conjunction with the starter card, and determining a payout by comparing at least one of the value of the player hand and the value of the crib hand to a pay table.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

FIG. 5 is a pay table for determining a payout in a cribbage game, according to an exemplary embodiment.

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

A single-player casino cribbage game is described. The cribbage game allows a player to place a wager on a single modified cribbage hand and receive a payout based on the number and type of cribbage combinations achieved during the hand. The cribbage game may be played on a video device within a casino, online in a casino-type gaming environment, or live as a single player table game. The cribbage game includes a single player playing against a payout table or against an expected set of outcomes or probabilities. The dealer deals a plurality of cards to the player and one or more cards to the crib. The player then discards at least one of the plurality of cards to the crib and is left with a player hand. The cards placed in the crib form a crib hand. A starter card is exposed by the dealer and a value is calculated or determined for both the player hand and the crib hand in conjunction with the starter card. A total value may also be calculated by totaling the value of the player hand and the value of the crib hand. A payout to the player is then determined based on one or more of the value of the player hand, the value of the crib hand, and the total value of the two hands.

Figure 1:
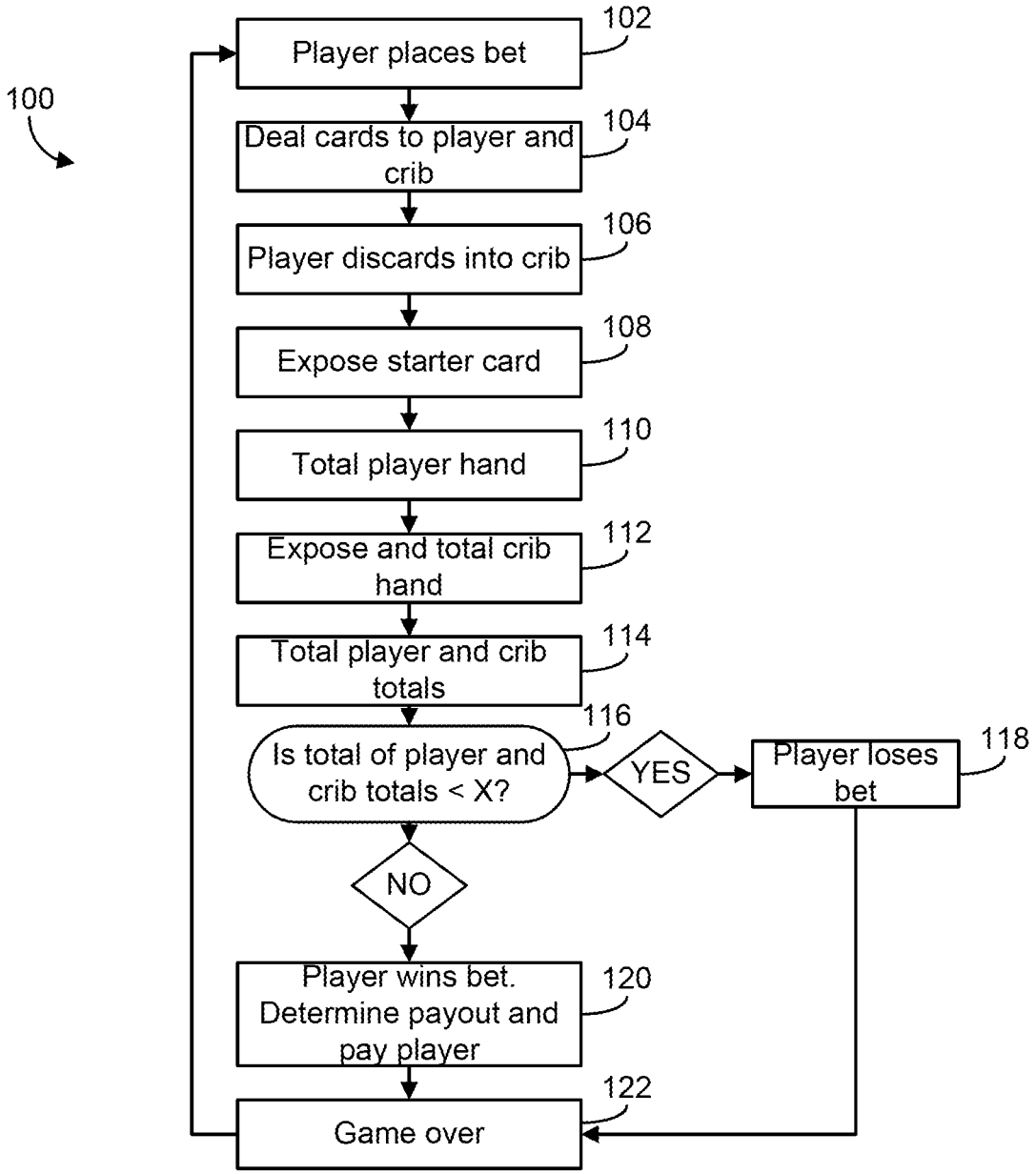
FIG. 1 is a flow diagram of a cribbage game, according to an exemplary embodiment.
Figure 2:
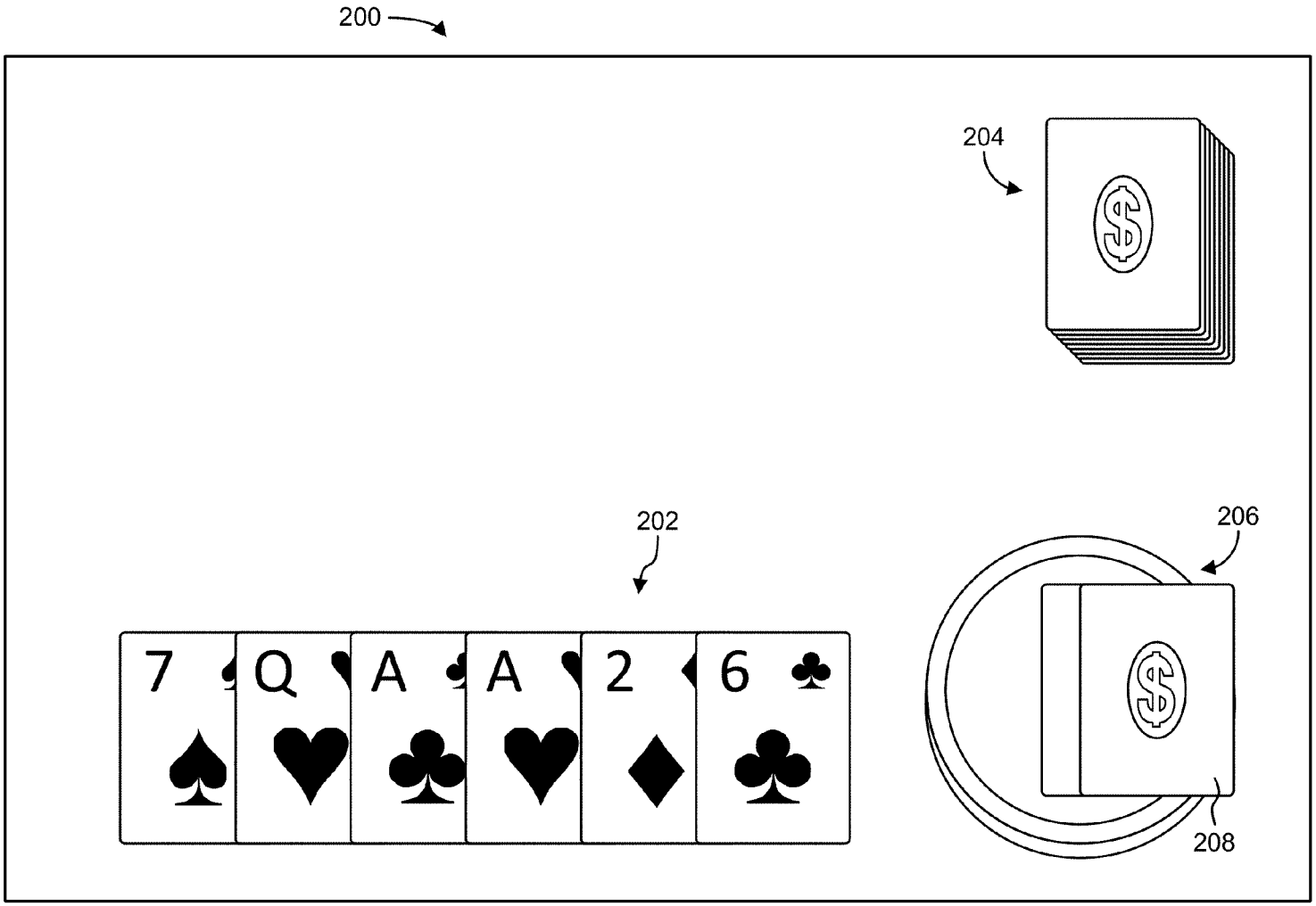
FIG. 2 is a screen view of a video cribbage game once the deal is completed, according to an exemplary embodiment.
Figure 3:
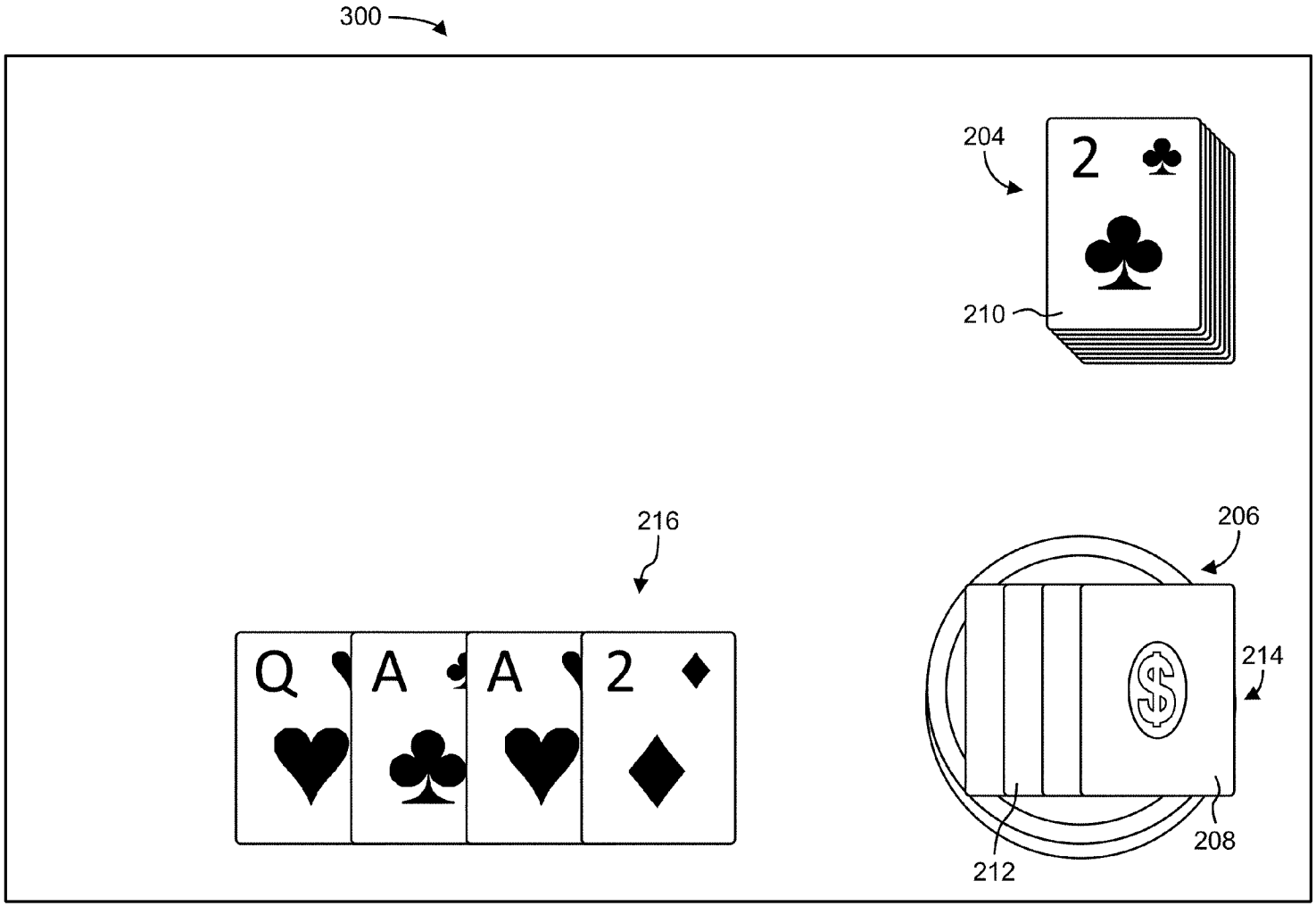
FIG. 3 is a screen view of the video cribbage game after the discard, according to an exemplary embodiment.
Figure 4:
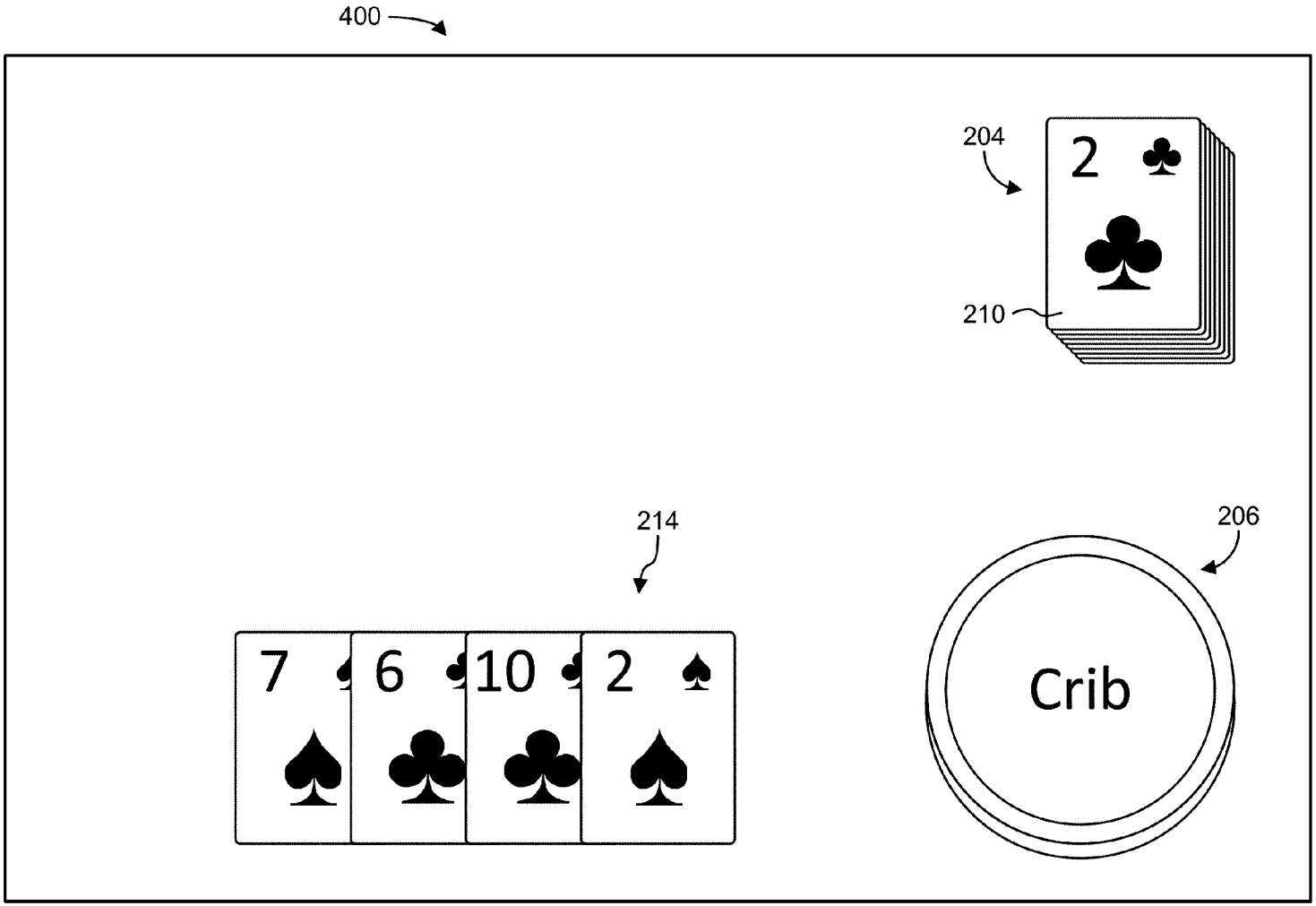
FIG. 4 is a screen view of the video cribbage game after the crib hand is exposed, according to an exemplary embodiment.

Referring to FIGS. 1-4, a cribbage game is shown according to an exemplary embodiment. In this embodiment, a single player plays the game without an opponent, losing a wager or receiving a payout based on the outcome of each particular game or hand in comparison to the probability of that outcome. For instance, the payout may be determined according to a payout table, which calculates the probability of each outcome and designates a particular payout for each outcome based on that outcome's probability. In FIG. 1, a process 100 is shown for implementing or providing the cribbage game. In FIGS. 2-4, screen shots 200, 300, 400 are shown for a video or online version of the cribbage game during three distinct stages of the game. However, the screen shots 200, 300, and 400 could also represent overhead plan views of a table game within a casino environment, and the description below may apply accordingly.

The game begins at 102 when the player places a bet or wager on the game (e.g., hand, round, deal, etc.). The game may allow a wager having a single denomination (e.g., five chips per game play), the game may allow varying wagers within a range, or the game may allow the player to make a wager of any denomination. In each case, the game automatically adjusts the payout according to the amount wagered (e.g., in proportion to the amount wagered, in a progressive payout structure, etc.). Once the wager is placed by the player, at 104 a plurality of cards 202 (e.g., player cards) are dealt to the player by the dealer from a deck 204. The cards 202 are randomly selected from the deck 204, either by shuffling or by a random number generator within a processing circuit. In one embodiment, the deck 204 includes a single deck of standard playing cards, but the deck 204 may include multiple decks in other embodiments. In an exemplary embodiment, the plurality of cards 202 includes six playing cards dealt from the deck 204. The cards 202 are dealt face up so that the player can view the suit and denomination of the cards 202. At 104, one or more cards 208 (e.g., crib cards) are also dealt to a crib 206 from the deck 204. The cards 208 are also randomly selected from the deck 204, either by shuffling the deck 204 or via a random number generator, for instance. In an exemplary embodiment, two playing cards 208 are dealt from the deck 204 to the crib 206. The cards 208 may be dealt to the crib 206 face down so that the player is not able to see the denomination or suit of the cards 208 until the cards 208 are purposely exposed as part of the game play. In another embodiment, the cards 208 are dealt to the crib 206 face up so that the player is able to identify the cards 208 and utilize the identity of the cards 208 as part of a game strategy. At 106, the player selects two of the cards 202 to discard. Each discard 212 is also sent to the crib 206. The discards 212 may be positioned face down (as shown in FIG. 3) or face up. In an exemplary embodiment, the discards 212 and the cards 208 dealt to the crib 206 from the deck 204 form a crib hand 214 comprising four cards (e.g., discards 212 and cards 208). When the discards 212 are selected by the player and removed from the plurality of cards 202, a player hand 216 is defined or formed by the remaining cards of the plurality of cards 202. In an exemplary embodiment, the player hand 216 includes four cards and includes the same number of cards as the crib hand 214.

Referring particularly to FIGS. 1 and 3, at 108 a starter card 210 (e.g., cut card, turn card, etc.) is exposed. In an exemplary embodiment, the starter card 210 is the card at the top of the deck 204 and is flipped over to expose or reveal the starter card 210, but in other embodiments, the starter card 210 may be otherwise selected or chosen. For instance, the player may select the starter card 210. In one embodiment, the player selects the starter card 210 by "cutting" or dividing the deck 204 by selecting a group of the cards within the deck 204, with the starter card 210 being the card at the bottom of selected group of cards. In another embodiment, the deck 204 is spread out face down so at least a portion of each of the cards within the deck 204 is accessible. In this embodiment, the player selects the starter card 210 from the deck 204 by selecting one of the face-down cards. In some embodiments, the game generates a random card regardless of the selection. In other embodiments, however, each of the cards has a denomination and suit that is predetermined before the player selects the starter card 210, such that the player actually determines (blindly) which of the cards from the deck 204 will be the starter card 210.

The starter card 210 may be combined with the player hand 216 and/or the crib hand 214 in order to make one or more cribbage combinations (e.g., pairs, runs, flushes, etc.). At 110, a value of the player hand 216 is determined in conjunction with the starter card 210 based on the cribbage combinations that are possible using the hand 216 and the starter card 210. In an exemplary embodiment, the value of the player hand 216 is a point total based on the scoring rules provided by the American Cribbage Congress (ACC). A scoring chart adapted from the ACC rules and suitable for the cribbage game of the present disclosure is listed below as an example.

| Cribbage Combinations | Pts. Earned |
|---|---|
| Jack turned by dealer as starter card | 2 |
| Jack in hand or crib of same suit as starter card | 1 |
| combinations: | |
| Two of a kind (pair) | 2 |
| Three of a kind (triple) | 6 |
| Four of a kind (quadruple) | 12 |
| Straights of three or more cards: per card | 1 |
| 15-count (sum of any combination of cards) | 2 |
| Four-card flush (only in the hand) | 4 |
| Five-card flush | 5 |

For instance, according to the above chart, a pair in the player hand 216 is worth two (2) points, a "run" or series of three straight cards is worth three (3) points, and two or more cards from the player hand 216 adding to exactly fifteen is worth two (2) points. In the illustrated embodiment of FIG. 3 (i.e., screen 300), the player hand 216 has a value of eight (8) points using the above scoring chart. In this embodiment, the player hand 216 includes two pairs (A-A and 2-2) each being worth two (2) points and two combinations of cards adding to fifteen (Q-2-2-Ah and Q-2-2-Ac) each being worth two (2) points, totaling to a value of eight (8) points for the player hand 216.

Referring particularly to FIGS. 1 and 4, at 112 the crib hand 214 is exposed (shown in FIG. 4) and a value of the crib hand 214 is determined in conjunction with the starter card 210. Like the value of the player hand 216, the value of the crib hand 214 is based on the cribbage combinations that are possible using the hand 214 and the starter card 210. Again, the value of the crib hand 214 may be a point total based on the scoring rules provided by the American Cribbage Congress, such as being based on the scoring chart above. In the illustrated embodiment of FIG. 4 (i.e., screen 400), for instance, the crib hand 214 has a value of six (6) points using the above chart. In this embodiment, the crib hand 214 includes a pair (2-2) for two (2) points and two combinations of cards adding to fifteen (7-6-2s and 7-6-2c) each being worth two (2) points, totaling to a value of six (6) points for the crib hand 214. In another embodiment, the cribbage game may use another set of scoring rules (other than those of the ACC) for determining the value (e.g., point value) of the player hand 216 and/or the crib hand 214, or the hands 216 and 214 may be otherwise valued as may be suitable for the particular application of the cribbage game. For instance, the value of the hands 214 and/or 216 may be determined based on the category or categories of cribbage combinations within the hands 214 and/or 216, such as assigning a binary value based on the presence of a particular type of combination.

At 114, the cribbage game includes totaling (e.g., summing) the value of the player hand 216 and the value of the crib hand 214 to calculate a total hand value. In an exemplary embodiment, the total hand value is the sum of the point totals for the player hand 216 and the crib hand 214. The game then determines a payout based on the value of the player hand 216, the value of the crib hand 214, and/or the total hand value. In the illustrated embodiment of FIG. 1, the game determines the payout based on the total hand value, comparing the total hand value to a payout table such as pay table 500 shown in FIG. 5 in order to determine the appropriate payout. The pay table 500 provides the payout for each possible point total for the total hand value according to the scoring rules of the ACC. The payouts are listed in the pay table 500 according to a player wager of five (5) units. The pay table 500 is calculated based on the probability of each particular outcome. For instance, a point total greater than fifty (50) has an extremely low probability and thus has a payout of one million (1,000,000) units for every five (5) units wagered. On the other hand, a point total less than sixteen (16) may have a very high probability and thus has a payout that is less than the amount of the initial wager. In other embodiments, the payouts may be higher or lower, adjusting in proportion to the amount of the wager, or the payouts may be raise or lower disproportionately from the change in the wager amount, such as a progressive payout. In some embodiments, for instance, the maximum payout may increase at a greater rate relative to the other payouts in order to provide an incentive for a player to place larger wagers. The pay table 500 is configured to provide a payback rate to the player of approximately 97.28%, or a profit rate to the game operator or dealer of approximately 2.72%. In some embodiments, the pay table 500 may be configured to provide a higher or lower payback rate to the player, to provide a higher or lower "jackpot" or maximum payout, or may be otherwise configured for any purpose suitable for the particular application of the cribbage game.

Referring again to FIG. 1, at 116 the cribbage game determines whether the total hand value is less than a specified value (X). If the total hand value is less than the specified value, the player loses the bet or wager at 118, the game is over at 122, and the player is again required to place a wager in order to play the game again. In an exemplary embodiment, the specified value corresponds to the pay table 500 such that the specified value is ten (10) points. In this embodiment, if the total hand value is less than ten (10) points, the player's wager is lost and the game is over until another wager is placed. If the total hand value is not less than the specified value, the player receives a payout. At 120, the game determines the payout. In an exemplary embodiment, the game determines the payout based on the pay table 500, with the payout corresponding to the calculated total hand value. Once the payout is paid to the player at 120, the game is over at 122 and the player is required to place another wager in order to receive the plurality of cards 202.

In an exemplary embodiment, the cribbage game is a single player game without a dealer or a dealer hand dealt from the deck 204. Cards are dealt at random from the deck 204 to form a player hand 216 and the crib hand 214 is formed by two discards 212 from the player and two cards dealt at random (e.g., crib cards) from the deck 204. The player makes a wager on a value (e.g., a value of the player hand 216, a value of the crib hand 214, a total hand value, etc.) of a set of cards in a cribbage environment, and then receives a payout based on a comparison of the value to a pay table reflecting the probabilities of each value combination.

Figure 6:
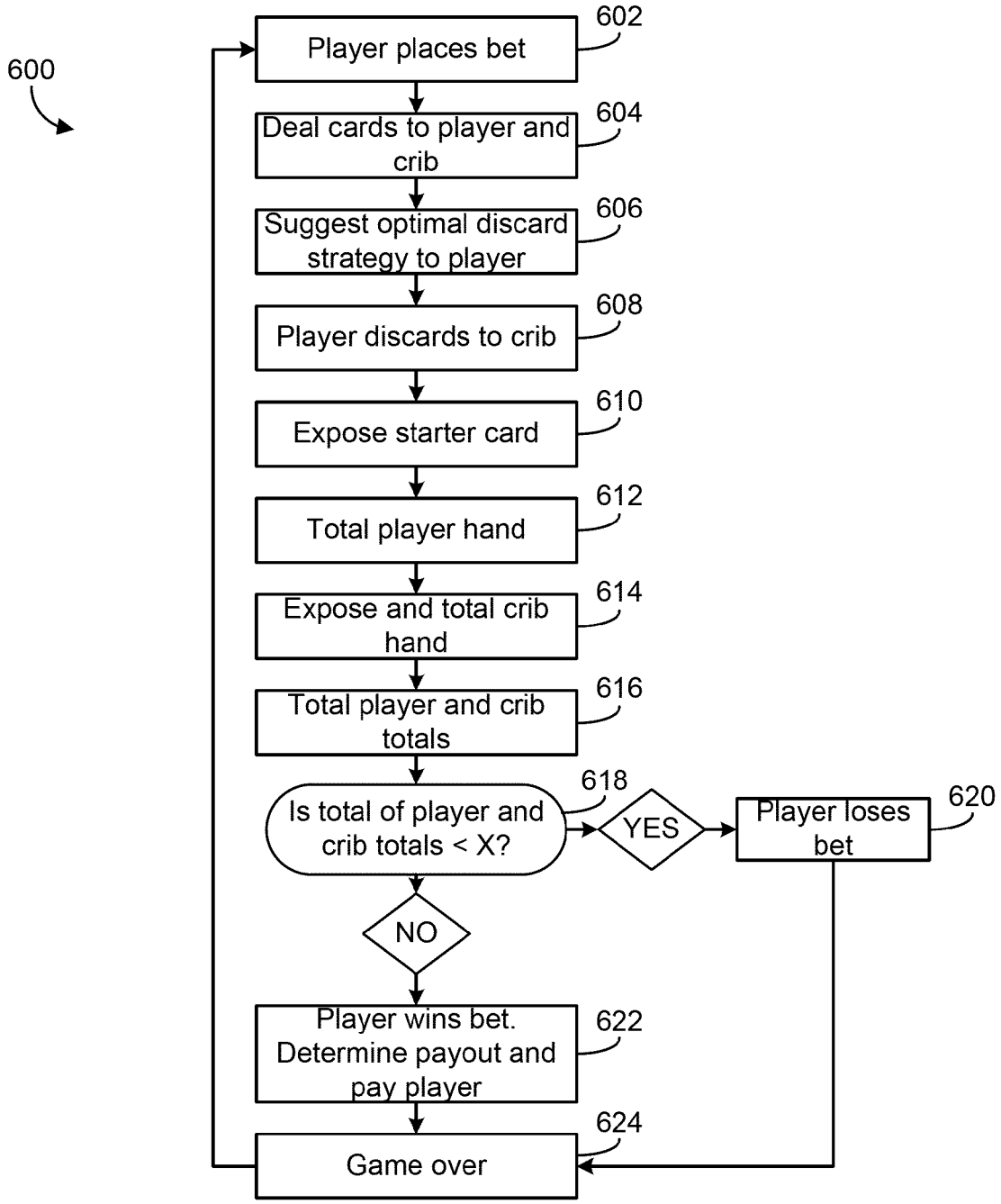
FIG. 6 is a flow diagram of a process for providing a cribbage game having an auto-hold feature, according to an exemplary embodiment.

Referring now to FIG. 6, a process 600 is shown for providing a cribbage game, according to an exemplary embodiment. The process 600 is similar to the process 100, but includes an "auto-hold" feature for optimizing player strategy. The player places the wager at 602 and cards are dealt to the player and the crib 206 at 604. However, at 606 the process 600 includes calculating and communicating an optimal player strategy to the player (i.e., the auto-hold feature). For instance, in an exemplary embodiment at 606 the game suggests an optimal discard strategy to the player. The optimal discard strategy may be intended to produce the highest expected value for the payout, or another desirable outcome. The optimal discard strategy may be communicated by highlighting the suggested discards, by placing the suggested discards in the crib 206 and requiring that the player accept the action, or by otherwise notating the suggested discards so that the player is aware of the optimal strategy to produce the highest expected value for the game. At 608, the player is required to discard to the crib 206, having ultimate control over the cards 202 that are discarded to the crib hand 214. At 610, the starter card 210 is exposed, either randomly as part of the process 600 or after selection by the player. At 612, the value of the player hand 216 is totaled. At 614, the crib hand 214 is exposed and the value of the crib hand 214 is totaled. At 616, the values of the crib hand 214 and the player hand 216 are totaled to determine the payout at 618 and 622.

Figure 7:
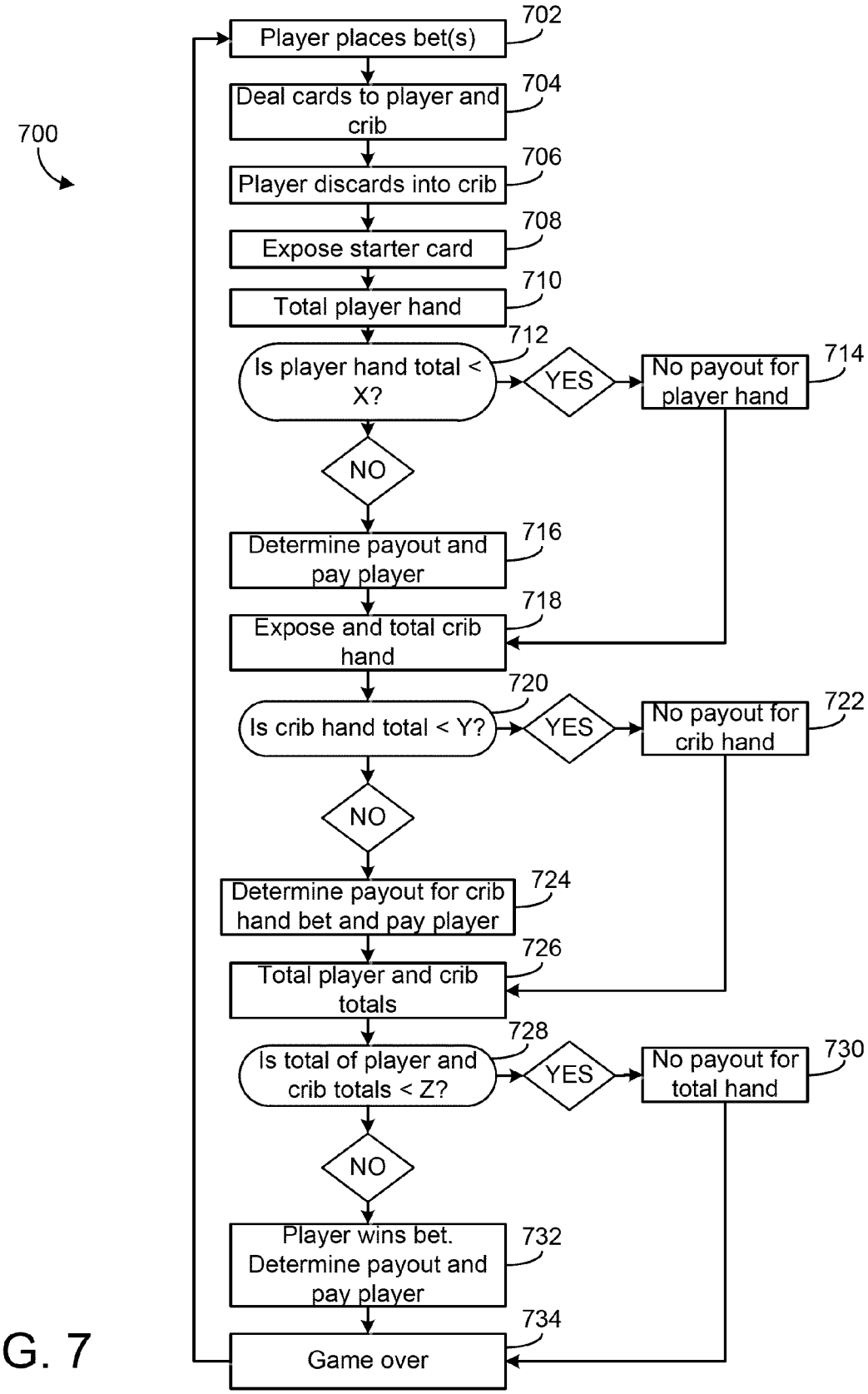
FIG. 7 is a flow diagram of a process for providing a cribbage game with multiple potential payouts, according to an exemplary embodiment.

Referring now to FIG. 7, a process 700 is shown for providing a cribbage game, according to an exemplary embodiment. The process 700 is similar to the processes 100 and 600. However, the process 700 allows the player to place more than one wager, and to wager on a value other than the total hand value, before the start of the cribbage game. The player places one or more wagers at 702. In this embodiment, the player is required to place at least one wager before the cards are dealt, but the player may be required to decide also whether to place a wager related to the value of the player hand 216, the value of the crib hand 214, and/or the total hand value before the cards are dealt. At 704, the cards are dealt to the player and the crib 206. At 706, the player discards to the crib 206. At 708, the starter card 210 is exposed. At 710, the value of the player hand 216 is calculated. At 712, the game determines whether a wager was made on the value of the player hand 216. If not, the game may skip to 718 of the process 700. If so, the game determines whether the value of the player hand 216 is less than a specified value (X). The specified value (X) may be predetermined or may be based on game play. In the illustrated embodiment, the game may be configured to set the specified value (X) to an infinite number when there is no wager on the value of the player hand 216, such that the value of the player hand 216 is less than the specified value (X) and no payout is provided to the player at 714. If there is a wager on the value of the player hand 216 and the value of the player hand 216 is not less than the specified value (X), the game determines the payout at 716 and pays the player. In an exemplary embodiment, the game compares the value of the player hand 216 to a single hand pay table similar to pay table 500 but configured to include probabilities for a single hand (e.g., the player hand 216).

At 720, the game determines whether a wager was made on the value of the crib hand 214. If not, the game may skip to 726 of the process 700. If so, the game determines whether the value of the crib hand 214 is less than a specified value (Y). The specified value (Y) may be predetermined or may be based on game play. The specified value (Y) may be equal to or of different value than the specified value (X). In the illustrated embodiment, the game may be configured to set the specified value (Y) to an infinite number when there is no wager on the value of the crib hand 214, such that the value of the crib hand 214 is less than the specified value (Y) and no payout is provided to the player at 722. If there is a wager on the value of the crib hand 214 and the value of the crib hand 214 is not less than the specified value (Y), the game determines the payout at 724 and pays the player. In an exemplary embodiment, the game compares the value of the crib hand 214 to a pay table similar to pay table 500 but configured to include probabilities for a single hand (e.g., the crib hand 214).

At 726, the game determines the total hand value based on the value of the crib hand 214 and the value of the player hand 216. At 728, the game determines whether a wager was made on the total hand value. If not, the game may skip to 734 of the process 700 and end the game. If so, the game determines whether the total hand value is less than a specified value (Z). The specified value (Z) may be predetermined or may be based on game play. The specified value (Z) may be equal to or of different value than the specified value (X) and the specified value (Y). In the illustrated embodiment, the game may be configured to set the specified value (Z) to an infinite number when there is no wager on the total hand value, such that the total hand value is less than the specified value (Z) and no payout is provided to the player at 730. If there is a wager on the total hand value and the total hand value is not less than the specified value (Z), the game determines the payout at 732 and pays the player. In an exemplary embodiment, the game compares the total hand value to a pay table such as pay table 500 to determine the payout.

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

In various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, a gaming system may include a plurality of EGMs that are each configured to communicate with a central server, central controller, or a remote host through a data network.

In certain embodiments in which the gaming system includes an EGM in combination with a central server, central controller, or remote host, the central server, central controller, or remote host is any suitable computing device (such as a server) that includes at least one processor and at least one memory device or storage device. The EGM may include at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs).

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (e.g., main cabinet 804 shown in FIG. 8). In other embodiments, at least one of the at least one processor of the EGM and the at least one memory device of the EGM reside outside the cabinet of the EGM.

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. It should be appreciated that, in some embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display decreases by one, and a number of credits shown in a bet display increases by one.

In other embodiments, one input device of the EGM is a cash out device. The cash out device is utilized to receive a cash payment or any other suitable form of payment corresponding to a quantity of remaining credits of a credit display.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are inputted to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, one input device of the EGM is a card reader in communication with the at least one processor of the EGM. The card reader is configured to read a player identification card inserted into the card reader.

Figure 8:
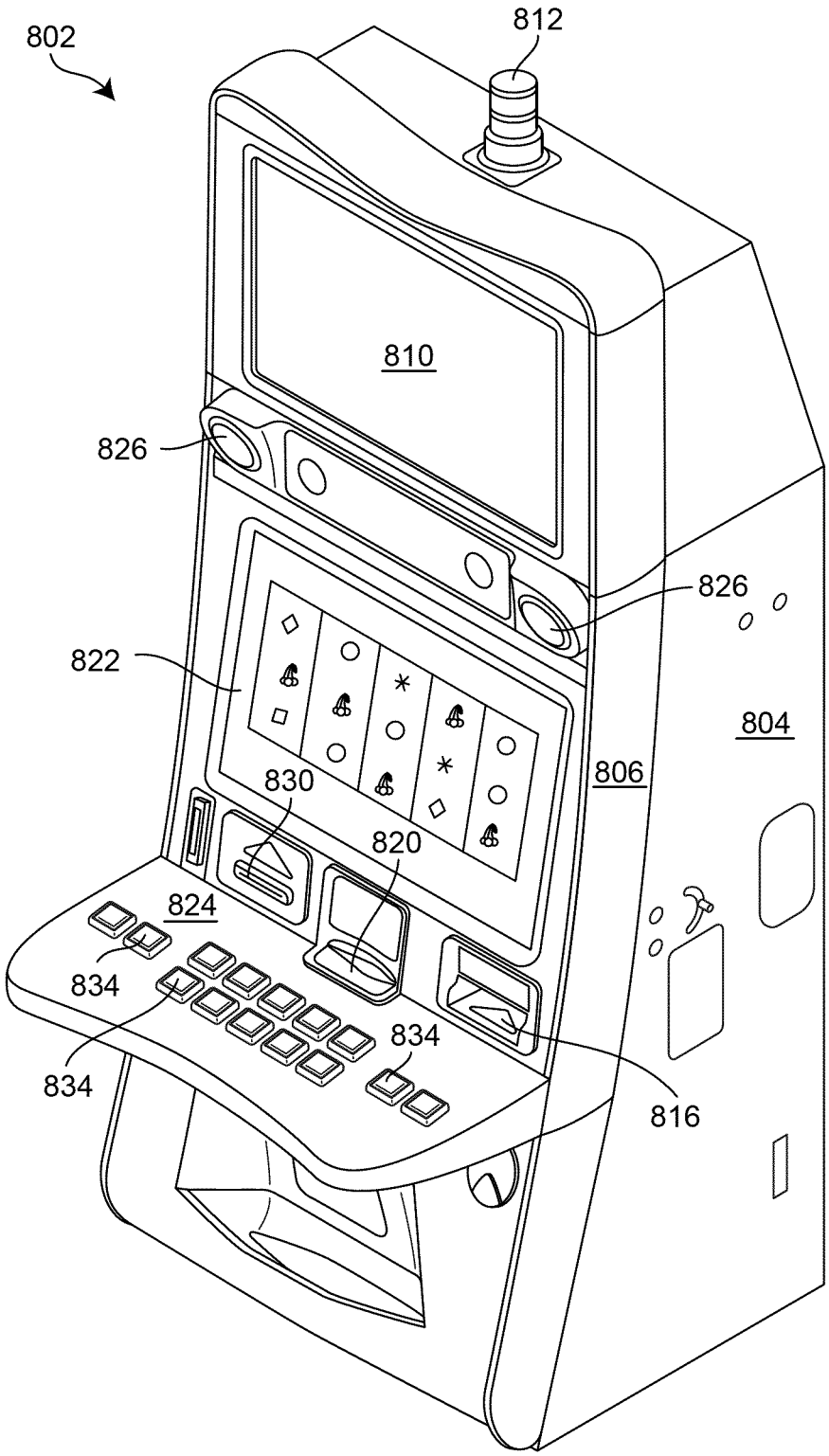
FIG. 8 is an illustration of a gaming device, according to an exemplary embodiment.

In various embodiments, the EGM includes one or more output devices (e.g., display 810 shown in FIG. 8). One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status; (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. In another such embodiment, the EGM provides dynamic sounds coupled with attractive multimedia images displayed on one or more of the display devices to provide an audiovisual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games, such as the cribbage game of the present disclosure (in certain embodiments), and one or more secondary games, such as the cribbage game of the present disclosure (in other embodiments). In various embodiments, the primary game(s) and the secondary game(s) may comprise any suitable games and/or wagering games, such as, but not limited to: electro-mechanical or video slot or spinning reel type games; video card games such as video cribbage, video draw poker, multi-hand video draw poker, other video poker games, video blackjack games, and video baccarat games; video keno games; video bingo games; and video selection games.

In certain embodiments in which the secondary game (such as when the cribbage game of the present disclosure is the primary game) or the primary game (such as when the cribbage game of the present disclosure is the secondary game) is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In certain such embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

Referring to FIG. 8, an example EGM for running or executing the cribbage game of the present disclosure is shown as electronic gaming device 802, in accordance with described embodiments. The gaming device 802 may include a main cabinet 804. The main cabinet 804 may provide a secure enclosure that prevents tampering with device components, such as a game controller (not shown) located within the interior of the main cabinet 804. The main cabinet 804 may include an access mechanism, such as a door 806, which allows the interior of the gaming device 802 to be accessed. Actuation of a door 806 may be controlled by a locking mechanism 814. In some embodiments, the locking mechanism 814, the door 806, and the interior of the main cabinet 804 may be monitored with security sensors of various types to detect whether the interior has been accessed. For instance, a light sensor may be provided within the main cabinet 804 to detect a change in light-levels when the door 806 is opened and/or an accelerometer may be attached to the door 806 to detect when the door 806 is opened.

The gaming device 802 may include any number of user interface devices that convey sensory information to a user and/or receive input from the user. For example, the gaming device 802 may include electronic displays 810, 822, speakers 826, and/or a candle device 812 to convey information to the user of the gaming device 802. The gaming device 802 may also include a console 824 having one or more inputs 834 (e.g., buttons, track pads, etc.) configured to receive input from a user. For instance, the player may place a wager, select the starter card 210, and/or select the discards 212 from the plurality of player cards 202 by manipulating the one or more inputs 834. In one embodiment, the display 810 and/or the display 822 may also be a touch screen display configured to receive input from a user. A controller (not shown) within the gaming device 802 may run a game, such as a wager-based game based on one or more of the processes 100, 600, and/or 700 described above, in response to receiving input from a user via the inputs 834, the display 822, or the display 810. For example, the inputs 834 may be operated to place a wager in the cribbage game and to run the cribbage game. In response, the controller may cause cards to be dealt from the deck 204, such as with a software-based cribbage game.

The gaming device 802 may also include devices for conducting a wager-based game (e.g., a video cribbage game). For example, the gaming device 802 may include a ticket acceptor 816 and a printer 820. In various embodiments, the gaming device 802 may be configured to run on credits that may be redeemed for money and/or other forms of prizes. The ticket acceptor 816 may read an inserted ticket having one or more credits usable to play a game on the gaming device 802. For example, a player of the gaming device 802 may wager one or more credits within a video cribbage game. If the player loses, the wagered amount may be deducted from the player's remaining balance on the gaming device 802. However, if the player receives a payout, the player's balance may be increased by the amount of the payout. Any remaining credit balance on the gaming device 802 may be converted into a ticket via the printer 820. For example, a player of the gaming device 802 may cash out of the machine by selecting to print a ticket via the printer 820. The ticket may then be used to play other gaming machines or redeemed for cash and/or prizes. According to various embodiments, the gaming device 802 may record data regarding its receipt and/or disbursement of credits. For example, the gaming device 802 may generate accounting data whenever a result of a wager-based game is determined. In some embodiments, the gaming device 802 may provide accounting data to a remote data collection device, allowing the remote monitoring of the gaming device 802.

In one embodiment, the gaming device 802 may include a loyalty card acceptor 830. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming device 802. For example, a user having a loyalty account may be given a bonus turn on the gaming device 802 or credited loyalty points for playing the gaming device 802.

Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal (e.g., a machine-generated electrical, optical, or electromagnetic signal) that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

receiving, by an acceptor, a physical item associated with a monetary value;

establishing, by at least one processor, a credit balance based at least in part on the monetary value associated with the received physical item;

receiving an actuation of a bet button;

placing, by the at least one processor, a primary bet for a player for a play of a single-player game in response to the received actuation of the bet button, the credit balance being decreasable by the primary bet;

for the play of the single-player game:

dealing, by the at least one processor, a plurality of player cards from at least one deck of cards to the player;

dealing, by the at least one processor, one or more crib cards directly from the at least one deck of cards to a crib hand and displaying, by at least one display device, at least one of the one or more crib cards face-up;

thereafter, receiving, by at least one input device, an input associated with at least one discard from the player cards to define a player hand from the remaining player cards;

moving, by the at least one processor, the at least one discarded player card to the crib hand such that the crib hand includes: (1) a first set of the one or more crib cards dealt face-up and directly from the at least one deck, and (2) a second set of the at least one discarded player card;

displaying, by the at least one display device, a starter card from the at least one deck of cards;

determining, by the at least one processor, a total player hand value based on the player hand and the starter card;

determining, by the at least one processor, a total crib hand value based on the crib hand and the starter card;

determining, by the at least one processor, a combined hand value based on the total player hand value and the total crib hand value; and resolving, by the at least one processor, the primary bet by determining one of a plurality of different awards by comparing the combined hand value to a pay table, the credit balance being increasable by the award, the pay table determined based in part on the primary bet;

receiving an actuation of a cashout button; and initiating, by the at least one processor, a payout associated with the credit balance in response to the received actuation of the cashout button.

2. The method of claim 1, further comprising:

determining, by the at least one processor, an additional award based on at least one of the total player hand value and the total crib hand value.

3. The method of claim 1, further comprising:

enabling the player to blindly select the starter card from the at least one deck of cards prior to exposing the starter card.

4. The method of claim 1, wherein the plurality of player cards comprises six playing cards and the at least one discard comprises two playing cards such that the player hand comprises four playing cards.

5. The method of claim 4, wherein the one or more crib cards comprises two playing cards such that the crib hand comprises four playing cards.

6. The method of claim 1, further comprising:

determining, by the at least one processor, an optimal player strategy; and communicating, by the at least one processor, the optimal player strategy to the player prior to receiving the at least one discard from the player.

7. The method of claim 6, which includes communicating, by the at least one processor, the optimal player strategy by identifying which of the plurality of player cards to discard to the crib hand to maximize an expected value of the award.

8. The method of claim 1, wherein the plurality of player cards and the one or more crib cards are dealt from the at least one deck of cards at random.

9. The method of claim 1, which includes determining, by the at least one processor, the total player hand value based on cribbage combinations within the player hand, and determining, by the at least one processor, the total crib hand value based on cribbage combinations within the crib hand.

10. The method of claim 1, wherein the play of the single-player game does not include a dealer hand.

11. A gaming device comprising:

a cabinet;

a display device coupled to the cabinet;

at least one input device coupled to the cabinet;

an acceptor supported by the cabinet; and a game controller coupled to the cabinet and the game controller configured to:

establish a credit balance based at least in part on a monetary value associated with a physical item after the acceptor receives the physical item;

place a primary bet for a player for a play of a single-player video cribbage game after receiving an actuation of a bet button, the credit balance being decreasable by the primary bet;

for the play of the single-player video cribbage game:

cause the display device to display to the player a plurality of player cards dealt from at least one deck of cards;

cause the display device to display to the player one or more crib cards dealt directly from the at least one deck of cards to a crib hand;

cause the display device to display at least one of the one or more crib cards face-up;

thereafter, after receiving at least one discard from the player cards, define a player hand from the remaining player cards;

cause the display device to display the at least one discarded player card moved to the crib hand such that the crib hand includes: (1) a first set of the one or more crib cards dealt face-up and directly from the at least one deck, and (2) a second set of the at least one discarded player card;

cause the display device to display a starter card from the at least one deck of cards;

determine a total player hand value based on the player hand and the starter card;

determine a total crib hand value based on the crib hand and the starter card;

determine a combined hand value based on the total player hand value and the total crib hand value; and resolve the primary bet by determining one of a plurality of different awards by comparing the combined hand value to a pay table, the credit balance being increasable by the award, the pay table determined based at least in part on the primary bet; and initiate a payout associated with the credit balance after receiving an actuation of a cashout button.

12. The gaming device of claim 11, wherein the game controller is configured to:

determine an additional award based on at least one of the total player hand value and the total crib hand value.

13. The gaming device of claim 11, wherein the game controller is configured to operate with the at least one input device to:

enable the player to blindly select the starter card from the at least one deck of cards prior to exposing the starter card.

14. The gaming device of claim 11, wherein the plurality of player cards comprises six playing cards and the at least one discard comprises two playing cards such that the player hand comprises four playing cards.

15. The gaming device of claim 14, wherein the one or more crib cards comprises two playing cards such that the crib hand comprises four playing cards.

16. The gaming device of claim 11, wherein the game controller is configured to:

determine an optimal player strategy; and communicate the optimal player strategy to the player prior to receiving the at least one discard from the player.

17. The gaming device of claim 16, wherein the game controller is configured to communicate the optimal player strategy by identifying which of the plurality of player cards to discard to the crib hand to maximize an expected value of the award.

18. The gaming device of claim 11, wherein the game controller is configured to deal the plurality of player cards and the one or more crib cards from the at least one deck of cards at random.

19. The gaming device of claim 11, wherein the game controller is configured to determine the total player hand value based on cribbage combinations within the player hand, and determine the total crib hand value based on cribbage combinations within the crib hand.

20. The gaming device of claim 11, wherein the play of the single-player video cribbage game does not include a dealer hand.

* * * * *